United States Patent [19]

Kallmann

[11] 4,125,992

[45] Nov. 21, 1978

[54] TWO FOR ONE TWISTER HAVING FREELY ROTATABLE GUIDE PLATE

[75] Inventor: Jürgen Kallmann, Kaarst, Germany

[73] Assignee: Palitex Project Company GmbH, Krefeld, Germany

[21] Appl. No.: 785,542

[22] Filed: Apr. 7, 1977

[30] Foreign Application Priority Data

Apr. 7, 1976 [DE] Fed. Rep. of Germany ..... 2614962

[51] Int. Cl.[2] ..... D01H 7/86

[52] U.S. Cl. ..... 57/58.83; 57/58.84

[58] Field of Search ..... 57/58.49, 58.7, 58.83, 57/58.84

[56] References Cited

U.S. PATENT DOCUMENTS

| | | | |
|---|---|---|---|
| 2,499,726 | 3/1950 | Cotterill | 57/58.83 X |
| 2,796,726 | 6/1957 | Klein | 57/58.84 |
| 2,867,969 | 1/1959 | Beyer | 57/58.83 |
| 3,788,055 | 1/1974 | Gabalda | 57/58.84 X |

*Primary Examiner*—Charles Gorenstein

*Attorney, Agent, or Firm*—Bell, Seltzer, Park & Gibson

[57] ABSTRACT

An improved spindle assembly construction for a textile yarn processing machine, such as a two-for-one twister and the like, which normally includes a rotatably driven rotor mechanism having a horizontally-extending reserve yarn storage disc and a generally vertically-extending hollow axle defining therewithin a yarn passageway extending therethrough and radially out of the storage disc, a stationary yarn supply package carrier mechanism rotatably mounted on the rotor mechanism so that the rotor mechanism rotates relative thereto, a yarn guide eyelet positioned above and in axial alignment with the hollow axle, and a driven yarn take-up winding mechanism, so that the yarn may be withdrawn from the supply package by the winding mechanism and pass through the passageway and through the eyelet to form a rotating balloon of yarn between the eyelet and the storage disc and around the carrier mechanism and the supply package as a result of the rotation of the rotor mechanism. The improvement includes a freely-rotatable, generally horizontally-extending plate means unattached to the storage disc and positioned between the storage disc and the eyelet within the balloon of yarn formed therebetween and being of a greater diameter than the carrier mechanism and the yarn supply package to substantially prevent contact therewith by the yarn in the rotating balloon and for allowing free rotation of the plate means with the rotating balloon at a speed less than the speed of rotation of the storage disc to reduce windage loss by and power consumption for driving the rotor mechanism which occurs when the plate means is attached to the storage disc.

10 Claims, 5 Drawing Figures

TWO FOR ONE TWISTER HAVING FREELY ROTATABLE GUIDE PLATE

This invention relates to an improved construction of a spindle assembly for a textile yarn processing machine, such as a two-for-one twister, which reduces windage loss by and power consumption for driving the rotor mechanism thereof.

BACKGROUND OF THE INVENTION

In many textile yarn processing machines, such as two-for-one twisters and the like, spindle assembly stations for the processing of yarn are positioned along each side of the machine. These spindle assembly stations each include a rotatably driven rotor mechanism having a horizontally-extending reserve yarn storage disc and a generally vertically-extending hollow axle defining therewithin a yarn passageway extending therethrough and radially out of the reserve yarn storage disc, a stationary carrier mechanism for carrying a hollow supply package of yarn and rotatably mounted on the rotor mechanism so that the rotor mechanism rotates relative thereto, a yarn guide eyelet positioned above and in generally axial alignment with the hollow axle, and a driven yarn take-up winding mechanism. With this construction of a spindle assembly, the yarn is withdrawn from the yarn supply package by the winding mechanism and passes through the yarn passageway in the hollow axle and out of the yarn passageway in the storage disc and then upwardly around the outside of the carrier mechanism and the supply package and through the eyelet to the winding mechanism to form a rotating balloon of yarn between the eyelet and the storage disc and around the carrier mechanism and the supply package as a result of the rotation of the rotor mechanism for imparting a two-for-one twist in the yarn. The supply yarn carrier mechanism usually includes a protective pot which is stationary with the carrier mechanism and extends around the outside of the supply package of yarn. There is usually also provided a balloon limitor mechanism which extends around and is spaced from the protective pot device for providing a space therebetween within which the rotating balloon of yarn passes.

The yarn storage disc serves the purpose of talking up a certain reserve of yarn between the location where the yarn emerges from the yarn passageway in the storage disc and the thread balloon to insure a constant yarn tension during processing and a resulting uniform processed yarn. Normally, as shown in Swiss Pat. No. 417,418 and U.S. Pat. Nos. 3,731,478 and 3,834,144, the latter two of which are assigned to the assignee of the present invention, the reserve yarn storage disc includes an outwardly-extending plate attached thereto and of greater diameter than the carrier mechanism including the protective pot thereof and the supply package of yarn, which rotates with the reserve yarn storage disc and the rotor mechanism and which provides a guiding surface within the balloon of yarn so that the balloon can develop into a given physically suitable shape that can rotate freely without coming in contact with the bobbin supply carrier or protective pot, if provided, or with the supply bobbin of yarn to prevent harmful effects caused to the moving yarn by constantly engaging a stationary surface.

However, the windage loss (friction between the rotor and the surrounding air) resulting from rotation of the spindle assembly rotor mechanism is greatly affected by the diameter of such plate, whereby the size of the rotary plate is included to the third or fourth power in the calculation of the windage losses which occur. Also, the greater the windage loss or friction caused by rotation of the rotor mechanism in the surrounding air, the greater the power consumption required for driving of the rotor mechanism.

When overlong, thin supply packages of yarn are utilized, which are often provided by producers of fine denier, continuous filament, synthetic yarn, spindle assemblies have been provided, such as shown in German Pat. No. 875,624, in which the rotating yarn balloon continually rubs against a stationary part of the spindle assembly such as the stationary carrier mechanism due to the overlong narrow configuration thereof dictated by the shape of the supply package. This causes friction between the rotating yarn balloon and the stationary parts of the spindle assembly resulting in fusing of the yarn and breakage therein. Also, yarns of this type are normally treated with softening and other agents that are inclined to deposit sediment and soil on the surface of the stationary parts of the spindle assembly contacted by the rotating balloon of yarn requiring stopping of the machine for cleaning cycles and resulting interruption in the work process which reduces the economical value of the machine operation.

Another known spindle assembly construction for yarn processing machines of this type is shown in German Patent 740,399 wherein the yarn introduced through the hollow spindle axle emerges at the lower end of the spindle radially through an aperture of a sleeve rotating with and at the same rotational speeds as the spindle rotor. To this is added a conically-expanding overrunning member likewise rotating at the rotational speed of the spindle rotor and along which member the yarn is guided. While a spindle assembly design of this type may prevent the harmful consequences of a spindle assembly design according to the aforementioned German Pat. No. 875,624 of constant frictional contact between the rotating balloon of yarn and stationary spindle assembly components, the spindle assembly design of this German Patent 740,339 suffers from the design deficiencies discussed above with respect to Swiss Pat. No. 417,418 by providing a greater windage loss and therefore the need of greater power consumption for driving the rotor mechanism of the spindle assembly.

OBJECTS AND SUMMARY OF THE INVENTION

Accordingly, it is the object of this invention to provide an improved spindle assembly construction for textile yarn processing machines, such as a two-for-one twister and the like of the type described above, which overcomes the disadvantages of the previously known, above discussed, spindle assemblies.

It is a further object of this invention to provide such an improved spindle assembly which reduces windage loss by and power consumption for driving the rotor mechanism of the spindle assembly, while preventing any substantially continuous contact between the rotating yarn balloon produced by the spindle assembly with stationary components of the spindle assembly.

It has been found by this invention that the above objects may be accomplished by providing, in a textile yarn processing machine, such as a two-for-one twister and the like, having spindle assembly stations for the processing of yarn and each including a rotatably driven rotor mechanism having a horizontally-extending reserve yarn storage disc and a generally vertically-extending hollow axle defining therewithin a yarn passageway extending therethrough and radially out of the reserve yarn storage disc, a stationary carrier mechanism for carrying a hollow supply package of yarn and rotatably mounted on the rotor mechanism so that the rotor mechanism rotates relative thereto, a yarn guide eyelet positioned above and in generally axial alignment with the hollow axle, and a driven yarn take-up winding mechanism, so that the yarn may be withdrawn from the yarn supply package by the winding mechanism and pass through the yarn passageway and through the eyelet to the winding mechanism to form a rotating balloon of yarn between the eyelet and the storage disc and around the carrier mechanism and the supply package as a result of the rotation of the rotor mechanism, the following improvement.

A freely-rotatable, generally horizontally-extending plate means unattached to the yarn storage disc is positioned between the reserve yarn storage disc and the yarn guide eyelet within the balloon of yarn formed therebetween and is of a greater diameter than the carrier mechanism and the yarn supply package to substantially prevent contact therewith by the yarn in the rotating balloon and for allowing free rotation of the plate means with the rotating balloon of yarn at a speed less than the speed of rotation of the reserve yarn storage disc to reduce windage loss by and power consumption for driving the rotor mechanism which occurs when the plate means is attached to the reserve yarn storage disc.

Preferably, the plate means is mounted for rotation on the axis of the rotor mechanism and includes an upwardly-extending rim to provide a generally pot-like shape thereto for providing a guiding surface for the yarn passing thereover. The reserve yarn storage disc is preferably of a smaller diameter than the freely-rotatable plate means to maintain the reduction in windage loss in the rotation of the rotor mechanism and the power required to drive the rotor mechanism.

A centrifugal clutch may be positioned between the reserve yarn storage disc and the freely rotatable plate means for providing a positive engagement therewith during start-up of the spindle assembly and for releasing such engagement after the plate means attains a predetermined speed.

In the case of a spindle assembly which has eliminated a protection pot therefrom due to an overlong narrow supply package of yarn, which is provided with fine denier, synthetic, continuous filament yarn, the freely-rotatable plate means would preferably be positioned above a bottom portion of the carrier mechanism and would include an upwardly-extending rim extending over a small portion of the lower part of the supply package of yarn to eliminate the need for such protective pot mechanism, while allowing free rotation thereof within the balloon of yarn.

Further specific features of the preferred embodiments of the spindle assemblies of this invention will be seen from the following more detailed description.

BRIEF DESCRIPTION OF THE DRAWINGS

Some of the objects and advantages of this invention having been set forth, other objects and advantages will appear when taken in conjunction with the accompanying drawings, in which.

DETAILED DESCRIPTION OF PREFERRED EMBODIMENT

While the drawings and specific description to follow will be related to a two-for-one twister yarn processing machine, which is the preferred form of apparatus having the improved spindle assembly construction in accordance with this invention incorporated therein, it is to be understood that the improvements on the spindle assembly construction in accordance with this invention could be utilized on other types of yarn processing machines having similar or related problems in the construction thereof.

Figure 1:
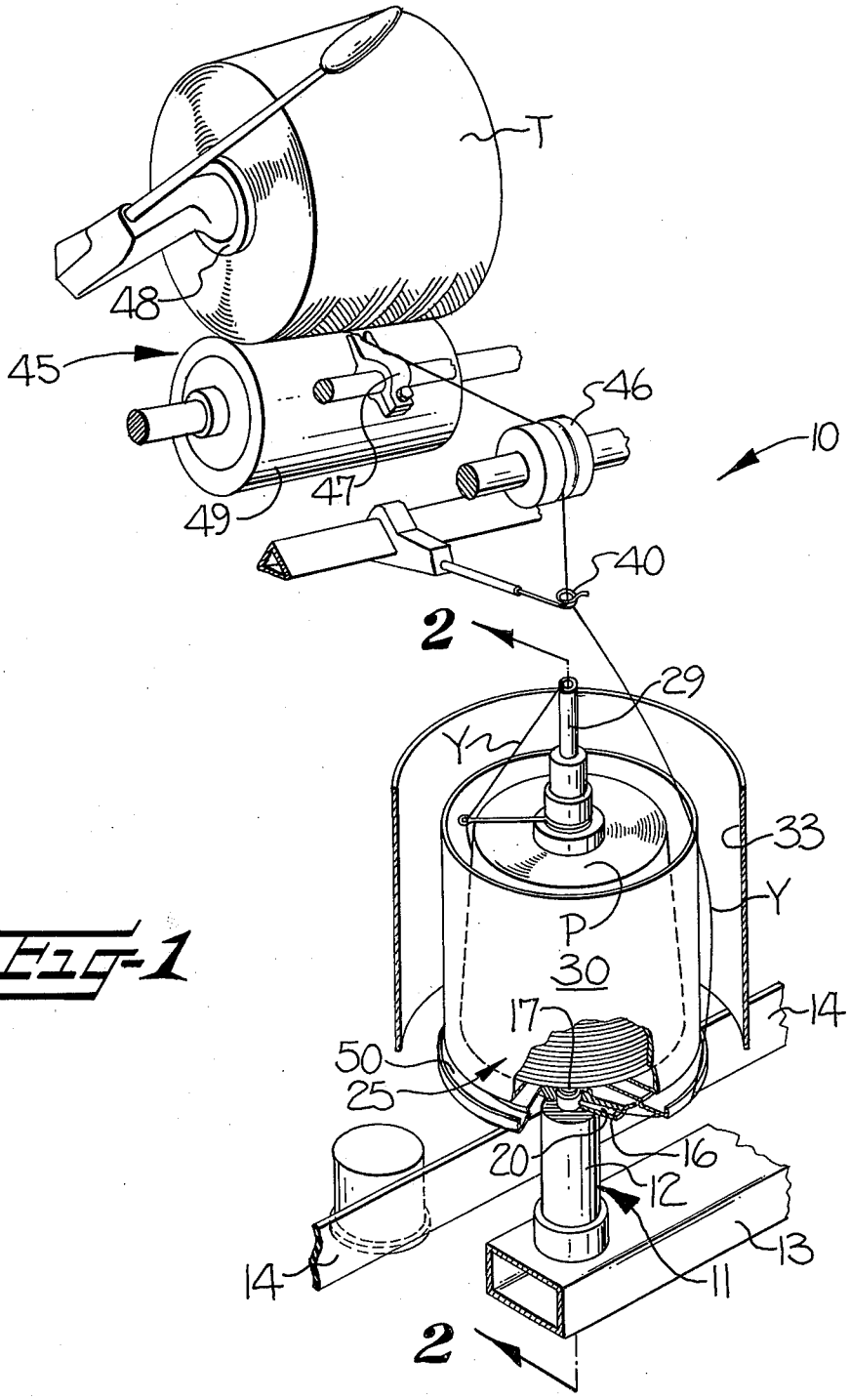
FIG. 1 is a schematic perspective view, partially broken away, illustrating one spindle assembly station of a two-for-one twister textile yarn processing machine utilizing the improved spindle construction of this invention.

Referring now to the drawings, there is illustrated in FIG. 1, a schematic, perspective view of a single spindle assembly station, generally indicated at 10, of a two-for-one twister yarn processing machine. It is to be understood that a plurality of these spindle assembly stations 10 are provided in which the spindle assembly stations are usually arranged in side-by-side relationship in two rows along the outsides of the machine. A full illustration and description of the entire two-for-one twister yarn processing machine is not given herein and is not believed to be necessary for an understanding of the present invention, the operation and structure of such a two-for-one twister being well understood by those with ordinary skill in the art.

Generally, each of the spindle assemblies 10 comprises a rotatably driven rotor mechanism, generally indicated at 11, which includes a whorl 12 suitably rotatably mounted on twister frame portion 13 and rotated by continuous drive belt 14. The rotor mechanism 11 further includes a generally horizontally-extending, reserve yarn storage disc 16 secured to the whorl 12 for being driven thereby and a generally vertically-extending hollow axle device 17 (see FIGS. 2–4) extending upwardly from and secured to the reserve yarn supply disc 16. The reserve yarn storage disc 16 and hollow axle 17 define a vertically-extending passageway through the hollow axle device and partly through the reserve yarn storage disc 16 and a generally horizontally-extending yarn passageway extending through a portion of and radially out of the reserve yarn storage disc 16, the yarn passageway being collectively indicated at 20.

Figure 2:
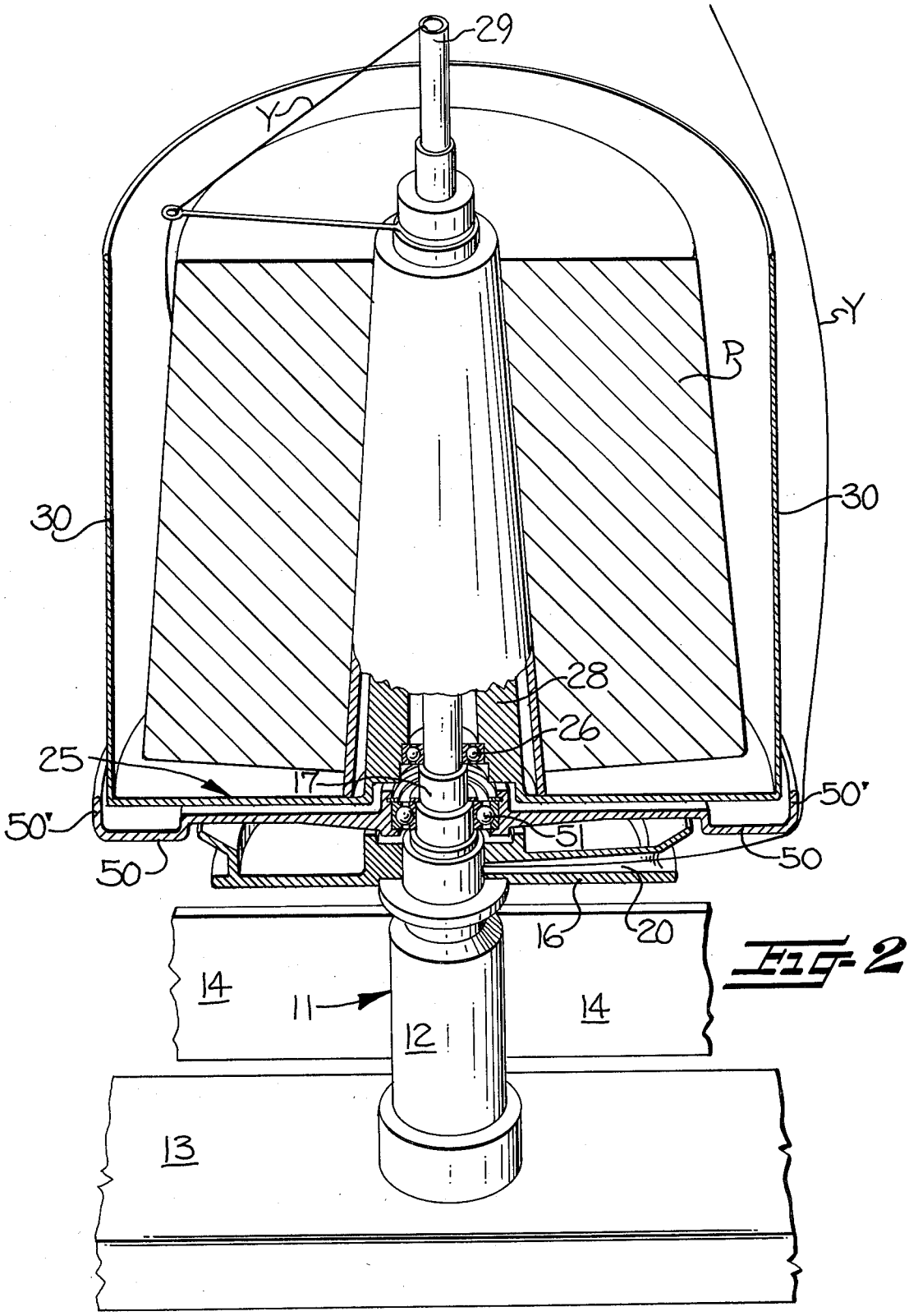
FIG. 2 is an enlarged view, taken substantially along the line 2—2 of FIG. 1.

The spindle assembly 10 further includes a carrier mechanism 25 for carrying a hollow package P of yarn Y and being rotatably mounted on the rotor mechanism by bearings 26 so that the rotor mechanism 11 may rotate relative to the carrier mechanism 25 which carries the package P of yarn Y. The carrier mechanism 25 may be held in stationary position by conventional magnets secured thereto and to a stationary portion of the twister frame, such as indicated at 27 in FIG. 5. The carrier mechanism 25 also includes a hollow yarn package carrier member 28 onto which the hollow package P of yarn Y is supported and a yarn entry 29 carried within the carrier member 28 and extending outwardly therefrom axially of the supply package P supported thereon for receiving the yarn Y from the supply package P and providing an axially extending passageway for receiving and allowing passage of the yarn Y therethrough and into the passageway 20 through the hollow axle device 17 and reserve yarn storage disc 16. The carrier mechanism 25 may further include a protective pot or basket device 30 which surrounds the package P of yarn Y, as shown in FIGS. 1 and 2.

The spindle assembly 10 may further include a balloon limitor device 33 surrounding the protective pot 30 so as to contain the balloon of yarn Y formed on the outside of the protective pot 30. A yarn guide eyelet 40 is positioned above and in axial alignment with the hollow axle 17 and the yarn entry tube 29 for receiving the yarn Y and forming the apex of the rotating balloon formed between the reserve yarn storage disc 16 and the eyelet 40. There is further provided a driven yarn take-up winding mechanism, generally indicated at 45, which includes a pretake-up roll 46, a yarn traversing mechanism 47, a take-up or package roll 48 upon which the yarn Y is wound into a package T after being processed or twisted by the spindle assembly 10. Package roll 48 is rotated by friction drive roll 49 contacting the outside surface of the take-up package T of yarn Y which is being wound by the take-up mechanism 45.

With the above described construction of spindle assembly 10, the yarn Y is pulled from the supply package P by the take-up winding mechanism 45 and passes through the yarn entry tube 29, through the passageway 20 in the hollow axle device 17 and reserve yarn storage disc 16 and radially out of the disc 16. The reserve yarn storage disc 16 takes up a reserve of yarn Y around its outside circumference to maintain a desired tension in the yarn Y and is therefore rotated by the rotor mechanism 11 at a faster speed than the resulting balloon of yarn Y. The yarn then passes upwardly between protective pot device 30 and the balloon limitor 33 and forms a rotating balloon of yarn Y, due to rotation of the rotor mechanism 11, which is contained by the balloon limitor device 33. The yarn Y then passes through the yarn guide eyelet 40, over pretake-up roll 46, and is traversed by the traversing mechanism 47 onto the take-up package of yarn T being formed on the take-up roll 48 to complete its travel through the respective spindle assembly 10. As is well understood by those with ordinary skill in the art, a two-for-one twist is inserted in the yarn during the above noted path of travel as a result of the rotation of the rotor mechanism 11.

The reserve yarn storage disc 16 conventionally includes an integral or attached plate which extends outwardly therefrom and rotates therewith for providing a guiding surface for the yarn Y emerging from the passageway 20 of the reserve yarn storage disc 16 to form a rotating balloon of yarn Y to provide as little contact as possible with the stationary parts of the supply package carrier mechanism 25, such as the protective pot 30. However, as discussed above, windage loss resulting from this increased diameter plate extending outwardly from reserve yarn storage disc 16 of the rotor mechanism 11 has created problems in power consumption necessary for driving the rotor mechanism 11.

Accordingly, in accordance with this invention, the improvement is provided of a freely-rotatable, generally horizontally-extending plate 50, which is unattached to the reserve yarn storage disc 16, and is mounted on the axis of the rotor mechanism 11 and positioned between the reserve yarn storage disc 16 and the yarn guide eyelet 40, which form the opposite ends of the rotating balloon of yarn Y, and within the balloon of yarn Y formed therebetween. The freely-rotatable plate 50 is of a greater diameter than the carrier mechanism 25, including the protective pot 30 if utilized, and the yarn supply package P to substantially prevent contact therewith by the yarn Y in the rotating balloon. The freely-rotatable plate 50 is mounted by bearings 51 for free rotation thereof and with the rotating balloon of yarn Y at a speed less than the speed of rotation of the reserve yarn storage disc 16 of the rotor mechanism 11. Contact by the rotating balloon of yarn Y with the freely-rotatable plate 50, along with bearing friction and windage causes rotation of the freely-rotatable plate 50 with the balloon of yarn Y. Accordingly, there is obtained a reduction in windage loss by and power consumption for driving the rotor mechanism which would occur when the plate 50 is attached to the reserve yarn storage disc 16.

The freely-rotatable plate 50 preferably includes an upwardly-extending rim portion 50' to provide a generally pot-like shape thereto for providing a guiding surface for the yarn Y passing thereover.

To prevent damage to the yarn Y during start-up of the spindle assembly 10 and while the freely-rotatable plate 50 is still motionless, there may be provided a centrifugal clutch mechanism, generally indicated at 55 (see FIGS. 3 and 4), which is positioned between the reserve yarn storage disc 16 and the freely-rotatable plate 50 for providing a positive engagement therebetween during start-up of the spindle assembly 10 and for releasing such engagement after the plate 50 attains a predetermined speed. Centrifugal clutch or brake devices have been conventionally utilized for stopping rotation of the spindle assembly.

Figure 3:
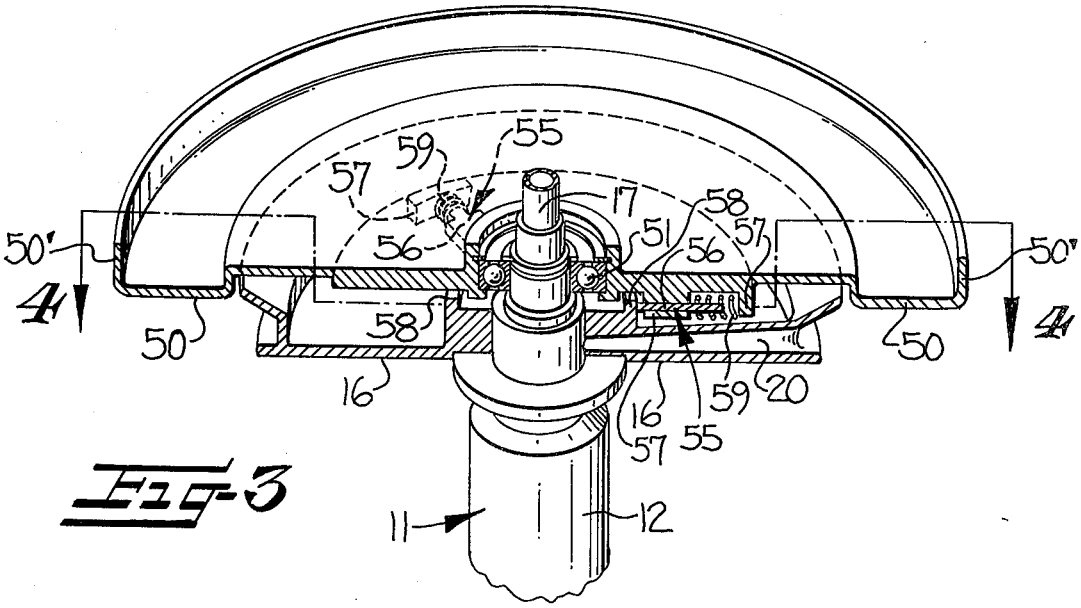
FIG. 3 is a cross-sectional view of a bottom portion of the spindle assembly of FIG. 2 with the preferred centrifugal clutch means utilized therein.
Figure 4:
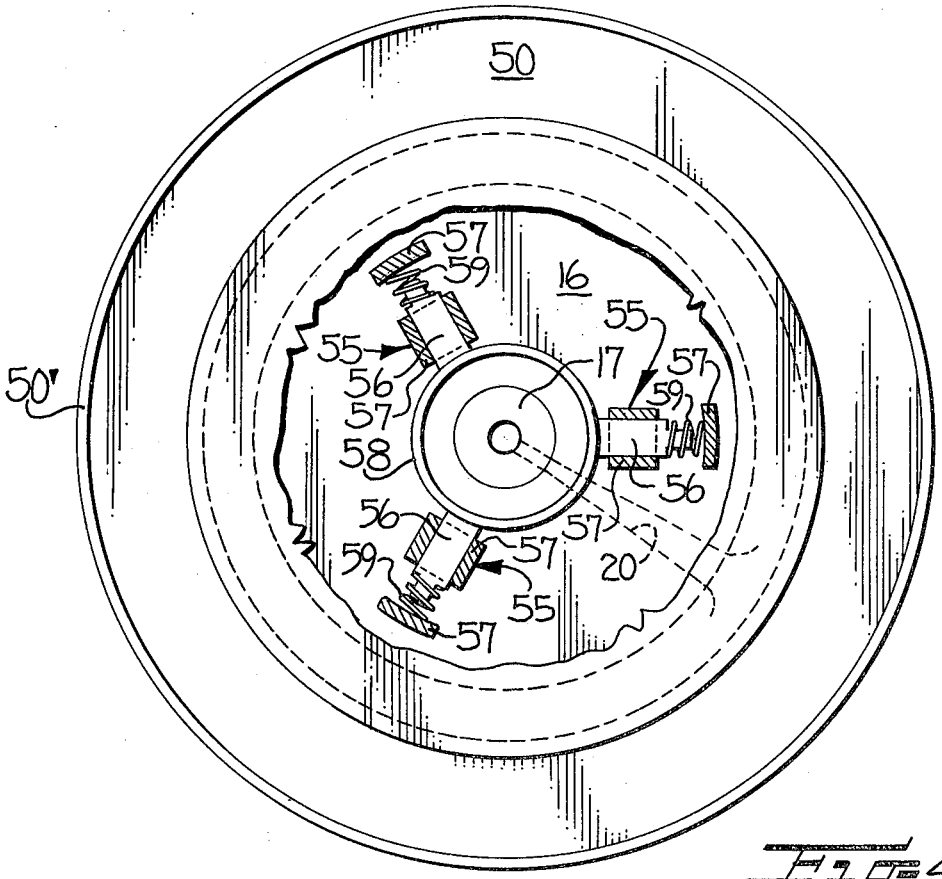
FIG. 4 is a view, taken generally along the line 4—4 of FIG. 3.

As illustrated in FIGS. 3 and 4, the centrifugal clutch device 55 may comprise friction clutch elements 56 carried by downwardly depending collars 57 of the plate 50 and mounted for radial movement toward and away from an upstanding hub portion 58 of the reserve yarn storage disc 16. The friction clutch elements are biased by a spring 59 into frictional engagement with the upstanding hub portion 58 of the reserve yarn storage disc 16. With this construction, when the rotor mechanism 11 of the spindle assembly 10 is started up for the processing of yarn Y, the freely-rotatable plate 50 will be carried through frictional engagement by the clutch elements 56 with the rotor mechanism 11 until such time as a predetermined speed of rotation of the plate 50 is attained and centrifugal force overcomes the biasing of spring elements 59 to allow disengagement of the friction clutch elements 56 with the upstanding hub 58 of the reserve yarn storage disc 16. Then, the plate 50 will be free to rotate under the influence of the rotating balloon of yarn Y, bearing friction and windage.

Figure 5:
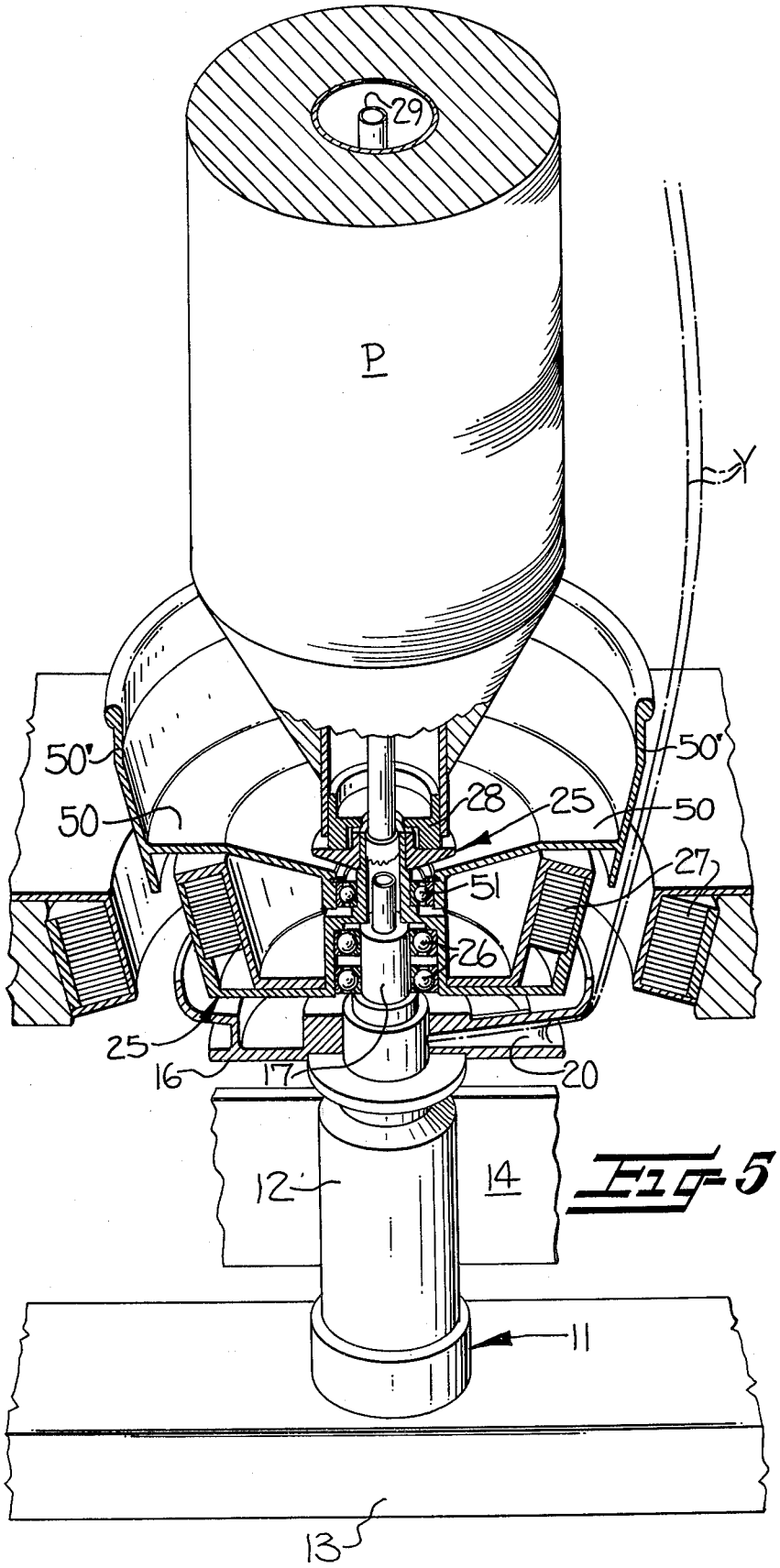
FIG. 5 is a view, like FIG. 2, illustrating an alternative construction of a spindle assembly as would be utilized with long narrow supply packages of fine denier, continuous filament, synthetic yarn utilizing the improved construction of this invention.

Referring now to the spindle assembly construction of FIG. 5, like reference numerals have been utilized in this spindle assembly in accordance with the above described construction of the spindle assembly 10 of FIGS. 1–4. This spindle assembly construction is utilized with producer provided, overlong, thin, supply packages of yarn X which are customary with fine denier, synthetic, continuous filament yarn. Since these supply packages P of yarn Y are overlong, it has been found that the protective pot mechanism 30 provides problems in constant frictional engagement by the rotating balloon of yarn Y. Therefore, the protective pots in such spindle assemblies have been shortened to cover only a lower portion of the supply package P of yarn Y.

In accordance with the present invention, this shortened protective pot mechanism has been made into the freely-rotatable plate 50 and is mounted by bearings 51 to be positioned above a bottom portion of the carrier mechanism 25 and includes an upward extending rim 50' for eliminating the need for a conventionally utilized, stationary protective pot mechanism forming a part of the carrier mechanism, while allowing free rotation thereof with the rotating balloon of yarn Y.

By the above construction, an improved spindle assembly construction for textile yarn processing machines, such as a two-for-one twister and the like, has been provided which reduces windage loss by and power consumption for driving the rotor mechanism of the spindle assembly, while preventing any substantial continuous contact between the rotating yarn balloon produced by the spindle assembly with stationary components of the spindle assembly.

In the drawings and specification, there have been set forth preferred embodiments of this invention, and although specific terms are employed, they are used in a generic and descriptive sense only and not for purposes of limitation.

What is claimed is:

1. In a textile yarn processing machine, such as a two-for-one twister and the like, having spindle assembly stations for the processing of yarn and each including a rotatably driven rotor mechanism having a horizontally-extending reserve yarn storage disc and a generally vertically-extending hollow axle defining therewithin a yarn passageway extending therethrough and radially out of said reserve yarn storage disc, a stationary carrier mechanism for carrying a hollow supply package of yarn and rotatably mounted on said rotor mechanism so that said rotor mechanism rotates relative thereto, a yarn guide eyelet positioned above and in generally axial alignment with said hollow axle, and a driven yarn take-up winding mechanism, so that the yarn may be withdrawn from the yarn supply package by said winding mechanism and pass through said yarn passageway and through said eyelet to said winding mechanism to form a rotating balloon of yarn between said eyelet and said storage disc and around said carrier mechanism and the supply package as a result of the rotation of said rotor mechanism; the improvement of:

a freely-rotatable, generally horizontally-extending plate means unattached to said yarn storage disc and being positioned between said reserve yarn storage disc and yarn guide eyelet within the balloon of yarn formed therebetween and being of a greater diameter than said carrier mechanism and the yarn supply package to substantially prevent contact therewith by the yarn in the rotating balloon and for allowing free rotation of said plate means by sliding frictional engagement around its outside circumference with the rotating balloon of yarn at a speed less than the speed of rotation of said reserve yarn storage disc to reduce windage loss by and power consumption for driving said rotor mechanism which occurs when said plate means is attached to said reserve yarn storage disc.

2. In a textile yarn processing machine, as set forth in claim 1, in which said freely-rotatable plate means includes means mounting said plate means for rotation on the axis of said rotor mechanism.

3. In a textile yarn processing machine, as set forth in claim 1, in which said freely-rotatable plate means includes an upwardly-extending rim to provide a generally pot-like shape thereto for providing a guiding surface for the yarn passing thereover.

4. In a textile yarn processing machine, as set forth in claim 1, having the further improvement of said reserve yarn storage disc comprising a disc of smaller diameter than said freely-rotatable plate means to maintain the reduction in windage loss in the rotation of said rotor mechanism and the power required to drive said rotor mechanism.

5. In a textile yarn processing machine, as set forth in claim 1, having the further improvement of a centrifugal clutch positioned between said reserve yarn storage disc and said freely rotatable plate means for providing a positive engagement therebetween during startup of said spindle assembly and for releasing such engagement after said plate means attains a predetermined speed.

6. In a textile yarn processing machine, as set forth in claim 5, in which said reserve yarn storage disc includes an upstanding hub portion, and said centrifugal clutch comprises at least one friction clutch element carried by said freely-rotatable plate means and extending radially inwardly toward said hub of said storage disc and being radially movable with respect to said freely-rotatable plate means, and biasing means biasing said friction clutch element into engagement with said hub of said storage disc for establishing the positive engagement therebetween during start-up of said spindle assembly and for being overcome by centrifugal force to release such engagement after said plate means attains a predetermined speed.

7. In a textile yarn processing machine, such as a two-for-one twister or the like, having spindle assembly stations for the processing of yarn and each including a rotatably driven rotor mechanism having a horizontally-extending reserve yarn storage disc and a generally vertically-extending hollow axle defining therewithin a yarn passageway extending therethrough and radially out of said reserve yarn storage disc, a stationary carrier mechanism for carrying a hollow supply package of yarn and rotatably mounted on said rotor mechanism so that said rotor mechanism rotates relative thereto, a yarn guide eyelet positioned above and in generally axial alignment with said hollow axle, and a driven yarn take-up winding mechanism, so that the yarn may be withdrawn from the yarn supply package by said winding mechanism and pass through said yarn passageway and through said eyelet to said winding mechanism to form a rotating balloon of yarn between said eyelet and said storage disc and around said carrier mechanism and the supply package as a result of the rotation of said rotor mechanism; the improvement of:

a freely-rotatable, generally horizontally-extending plate means unattached to said yarn storage disc and mounted on the axis of said rotor mechanism and being positioned between said reserve yarn storage disc and said yarn guide eyelet within the balloon of yarn formed therebetween and being of a greater diameter than said carrier mechanism and the yarn supply package to substantially prevent contact therewith by the yarn in the rotating balloon and for allowing free rotation of said plate means by sliding frictional engagement around its outside circumference with the rotating balloon of yarn at a speed less than the speed of rotation of said storage disc, and said reserve yarn storage disc comprising a disc of smaller diameter than said freely rotatable plate means; whereby, there is obtained a reduction in windage loss by and power consumption for driving said rotor mechanism which occurs when said plate means is attached to said reserve yarn storage disc.

8. In a textile yarn processing machine, as set forth in claim 7, in which said supply package carrier mechanism includes a protective pot device extending around the outside of the supply package of yarn, and said freely-rotatable plate means is of a larger diameter than said protective pot device and includes an upwardly-extending rim to provide a generally pot-like shape thereto for providing a guiding surface for the yarn passing thereover outside of said protective pot device.

9. In a textile yarn processing machine, as set forth in claim 7, in which said freely-rotatable plate means is positioned above a bottom portion of said carrier mechanism and includes an upwardly-extending rim extending over a small portion of the lower part of the supply package of yarn to eliminate the need for a conventionally used protective pot mechanism forming a part of the carrier mechanism while allowing free rotation thereof with the rotating balloon of yarn.

10. In a textile yarn processing machine, as set forth in claim 7, having the further improvement of a centrifugal clutch positioned between said reserve yarn storage disc and said freely-rotatable plate means for providing a positive engagement therebetween during start-up of said spindle assembly and for releasing such engagement after said plate attains a predetermined speed.

* * * * *